United States Patent [19]

Cardin et al.

[11] Patent Number: 4,674,440

[45] Date of Patent: Jun. 23, 1987

[54] APPARATUS FOR AUTOMATICALLY REPLENISHING AN ELECTROLESS PLATING BATH

[75] Inventors: William J. Cardin, Merrimack, N.H.; Michael Gulla, Sherborn, Mass.; Charles L. Newton, Clearwater, Fla.

[73] Assignee: Shipley Company Inc., Newton, Mass.

[21] Appl. No.: 748,968

[22] Filed: Jun. 26, 1985

Related U.S. Application Data

[62] Division of Ser. No. 667,738, Nov. 2, 1984, Pat. No. 4,565,575.

[51] Int. Cl.[4] ..... B05C 11/10

[52] U.S. Cl. ..... 118/688; 118/712

[58] Field of Search ..... 118/688, 712; 427/8; 422/111

[56] References Cited

U.S. PATENT DOCUMENTS

| | | | |
|---|---|---|---|
| 3,310,430 | 3/1967 | Schneble et al. | 106/1.23 |
| 3,361,580 | 1/1968 | Schneble et al. | 106/1.23 |
| 4,096,301 | 6/1978 | Slominski et al. | 427/8 X |
| 4,276,323 | 6/1981 | Oka et al. | 106/1.23 |

*Primary Examiner*—Evan K. Lawrence

*Attorney, Agent, or Firm*—Robert L. Goldberg

[57] ABSTRACT

An apparatus for maintaining the consumable components of an electroless plating solution at predetermined concentration in a plating tank containing the plating solution while workpieces are being processed in the tank. The apparatus measures the concentrations of the consumable components in a sample stream of the electroless plating solution and based on these measurements, meters the required amounts of the components into the plating solution. A portion of the apparatus provides for the introduction of plating solution poison into the sample stream to prevent autocatalytic decomposition and deposition of the plating metal, e.g., copper, onto to the walls and sensors of the apparatus.

4 Claims, 1 Drawing Figure

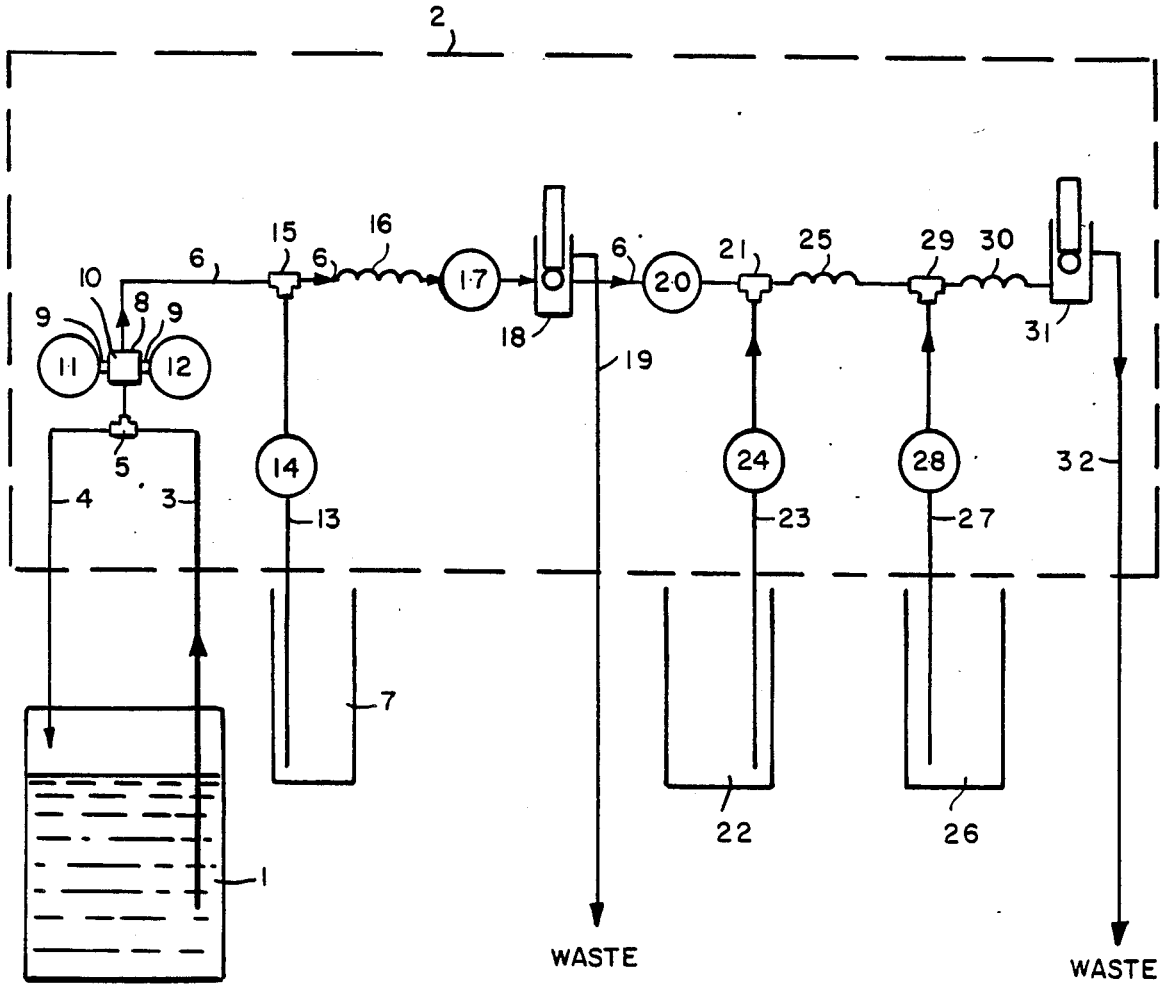
2
6
15
6
16
17
6
20
21
25
29
30
10
8
9
9
11
12
18
19
31
5
14
24
28
32
4
3
13
23
27
7
22
26
1
WASTE
WASTE

APPARATUS FOR AUTOMATICALLY REPLENISHING AN ELECTROLESS PLATING BATH

This is a division of application Ser. No. 667,738 filed Nov. 2, 1984, now U.S. Pat. No. 4,565,575.

BACKGROUND OF THE INVENTION

1. Introduction

This invention relates to an apparatus for automatically controlling the composition of an electroless plating solution whereby the components of the plating solution are maintained nearly constant during use of the plating solution.

2. Description of the Prior Art

In the past, electroless plating solutions in commercial use have been controlled through manual analysis of the plating solution during use followed by manual addition of plating components as shown to be necessary by analysis. A disadvantage of this procedure is that by the time the analysis is performed and the replenishment requirements calculated, the plating solution, assuming it has been operating continuously, will have undergone further compositional change so that the component levels calculated may be as much as 10% to 20% inaccurate at the time the additions are actually made to the bath. This change in the concentration levels results in inconsistency in deposit characteristics and properties.

If the workload in the plating bath is reasonably constant or can be calculated, it is possible to program the additions of components necessary to replenish a bath so that they can be periodically made with some degree of success. However, it is still necessary to verify the concentrations by analysis at least several times during a working day. To eliminate that time-lag encountered in manual analysis and uncertainty of unprogrammed or periodic additions to a plating solution, attempts have been made to automate the analysis and to control the addition of consumed components by additions of replenishers on a continuous basis. In this respect, using an electroless copper plating solution as an example, it is known that the principal reaction occurring in a plating bath during a plating operation is that reaction represented by the following equation:

$$Cu^{++}+2HCHO+4OH^{-}\rightarrow Cu^{o}+H_2+2H_2O+2HCOO^{-}.$$

As can be seen from the above equation, the consumable ingredients in the plating solution are copper, formaldehyde and hydroxide which react in a definite stochiometric ratio and must be replenished in the same ratio to maintain the composition of the plating solution constant. It would appear that, because of the stoichiometric relationship, monitoring any of these ingredients would provide the necessary information for controlling the replenishment of the three ingredients. In practice, it has been found that there are additional side reactions which take place independently of the main reaction beyond that described above. The most serious of these reactions is the well known Canizzaro reaction where formaldehyde and hydroxide react with each other in accordance with the following equation:

$$2HCHO+OH^{-}—CH_3OH+HCOO^{-}$$

From the above equation, it would appear that in addition to copper, formaldehyde and hydroxide should be monitored, but monitoring either could provide a determination of the amount of the unmonitored component through calculation. In practice, this is not the accurate because formaldehyde evaporates from solution and hydroxide reacts with carbon dioxide in the air resulting in additional loss not accounted for by the above equations. Nonetheless, a two-component monitoring control device using copper and hydroxide as a basis for programming a control system is the subject of U.S. Pat. No. 3,532,519, incorporated herein by reference. This patent discloses a method for monitoring copper and hydroxide and further discloses the use of hydroxide content to determine formaldehyde content.

In the method disclosed in the patent, a sample stream from the plating bath is pumped through a colorimeter for copper determination, and through a pH meter for a determination of the pH of the bath. The system of the patent provides for a preselected set-point established by either the colorimeter or the pH indicator, whereby a relay activates an appropriate pump to introduce aqueous alkali hydroxide solution and/or mixed formaldehyde and copper salt solution, until the sample readings taken from the bath again return to normal or the pre-set condition. This method is also summarized in "GALVANOTECHNIK," 61(3), 215 (1970) by W. Immel, also incorporated herein by reference.

The prior art methods disclosed in the aforesaid publications have been found less than satisfactory with modern highly active electroless copper solutions because the device does not account for formaldehyde loss through evaporation and hydroxide loss through reaction with the carbon dioxide in the air. In addition, the copper in such solutions undergo autocatalytic deposition after relatively short periods of operation of the system, producing deposition on the colorimeter walls as well as on the pH electrodes thereby causing inaccurate readings and unreliable functioning of both control systems. Also, the pH of the operating bath is not a reliable indicator of the hydroxide concentrations under the conditions employed, since modern plating solutions operate at a pH of 12.5 or higher where the reading is no longer linear with hydroxide concentration due to buffering and sodium ion interference.

In U.S. Pat. No. 4,096,301, incorporated herein by reference, there is disclosed a method and apparatus for monitoring and adjusting the composition of an electroless copper plating solution which involves withdrawing a sample stream from the running bath and running this through three separate analysis stations. It is disclosed in said patent that an essential part of the analysis procedure utilizes a test acid solution of known, standardized normality introduced at a constant feed rate and mixed into the sample stream to produce an optimum pH level as a datum level for a first analysis. Change in pH from this level is said to provide a signal of hydroxide concentration changes occurring in the plating bath since such change is an analog of the hydroxide content of the working bath. This creates a control for providing for signaling for replenishment of hydroxide to the bath to maintain a desired working level of the component. The acidification is also said to serve the purpose of reducing the sensitivity of the sample solution to autocatalytic degradation resulting in plate-out of metal onto the sensing members of the analyzing instruments in the controller. Absent plate-out on the sensing members, accurate colorimetric readings are obtainable for controlling the replenishment of the copper in the plating bath. Finally, the patent teaches a second pH analysis of the acidified sample stream following addition of a test sulfite solution of known strength and rate of addition. Sulfite reacts with formaldehyde to produce hydroxide ions raising the pH of the sample. This reading is made continuous and a change from a predetermined level is utilized to signal addition to the plating bath of formaldehyde.

Though the invention disclosed in U.S. Pat. No. 4,096,301 is an improvement over the prior art, it has been found in practice that acidification of the sample stream does not completely eliminate autocatalytic degradation and consequently, plate-out does occur on the sensing members, albeit at a slower rate than in prior art control devices. Consequently, the colorimeter is coated with metal affecting its function and its ability to measure copper content. In addition, other lines within the controller become plugged with plated copper after prolonged use of the control device which interferes with its operation. Finally, the system suffers from inaccuracy for failing to account for formaldehyde evaporation and hydroxide losses by reaction with carbon dioxide.

SUMMARY OF THE INVENTION

The subject invention is an improvement over the apparatus of the aforesaid U.S. Pat. No. 4,096,301 in that it eliminates plate-out within a control apparatus by metering a solution of a plating solution poison into a sample stream removed from the plating solution for analysis. Divalent sulfur compounds are preferred plating poisons as minor amounts added to a test stream of plating solution virtually eliminates autocatalytic degradation and plate-out of copper onto sensing devices within the controller apparatus. In addition, the control device of the subject invention monitors copper, formaldehyde and hydroxide separately and provides an accurate determination of all components.

In accordance with the apparatus of the invention, the concentration level of the three major consumable components of a plating solution can be continuously monitored and maintained free of interference problems previously encountered as the result of metal deposition onto the sensing elements of monitoring instruments.

DESCRIPTION OF THE DRAWING

The single FIGURE is a schematic flow diagram of the apparatus of the invention.

DETAILED DESCRIPTION OF THE INVENTION

The invention is in part predicated upon the use of a plating poison added to the plating solution to deactivate the same and prevent autocatalytic degradation on the interior parts of the control device. Plating poisons are well known in the art and disclosed in numerous patents including U.S. Pat. Nos. 3,310,430 and 3,361,580, both incorporated herein by reference.

Both of the foresaid patents are directed to the stabilization of metal plating baths by the addition of stabilizers. It is known in the art that most stabilizers added to a plating bath are added in minor amount to stabilize the solution against autocatalytic degradation, but when such stabilizers are added in larger amount, e.g., about 10 parts per million parts of solution or more per liter, dependent upon the efficacy of the stabilizer, most function as a plating poison preventing deposition from the plating solution. The stabilizers disclosed in U.S. Pat. No. 3,310,430 comprise a diverse group of materials including cyanide salts, vanadium, molybdenum, niobium, tungsten, rhenium, arsenic, antimony, bismuth, rare earths of the actinium series and rare earths of the lanthinum series. The majority of these materials are plating poisons in amounts in excess of 10 parts per million parts of solution. The stabilizers of U.S. Pat. No. 3,361,580 are sulfur compounds such as aliphatic sulfur-nitrogen compounds including thiocarbonates such as thiourea; five membered heterocyclics containing sulfur-nitrogen groups in the five membered ring, such as thiazoles and iso-thiazoles including 2-mercapto benzothiazole and the like, dithiols such as 1,2-ethanedithiol and the like; 6 membered heterocyclics containing sulfur-nitrogen groups in the ring such as thiazines including 1,2-benzoiso-thiaziane, benzothianine; thioamino acids such as methionine cystine, cysteine, and the like; thio derivatives of alkyl glycols such as 2,2'-thiodiethanol, dithiodiglycol and thioglycollic acids and the like. Inorganic sulfur compounds may also be used including alkali metal thiocyanates such as sodium and potassium thiocyanate; and alkali metal dithionates such as sodium and potassium dithionate.

Of the stabilizers that function as plating poisons described above, thiourea is the most preferred because it is non-toxic, may be discharged to the environment, is readily available and is low in cost. In addition, it is capable of functioning as a plating poison in relatively low concentration.

The invention will be better understood by reference to the drawing where plating solution from a plating tank 1 is continuously circulated from the tank to a controller 2 schematically represented in the drawings as dashed line through line 3 with excess of the sample stream discharged through line 4. The flow through line 3 is preferably high speed such as 200 ml/minute or more so that the controller can be located remote from the plating tank without a long time lag prior to replenishment. A controlled and limited amount of solution is metered into the control apparatus through check valve 5. Typically, from about 2 to 10 ml/minute and preferably about 4 ml/minute are adequate for measuring the concentration of solution components within the controller.

The solution is passed to sensing means within the controller from check valve 5 through line 6. At this point in the process, an acidified solution of plating poison from holding tank 7 may be metered into the plating solution to poison the solution and prevent autocatalytic decomposition. However, with the improved means for monitoring copper concentration utilized in the control apparatus, as described below, it is not mandatory that the poison be added at this point.

In the preferred embodiment of the invention, the plating solution passing through check valve 5 into controller 2 immediately passes through copper sensor 8 which measures copper concentration. The sensor comprises two fiber optic elements 9 within flow through chamber 10 where the elements have flat ends space apart from each other in abutting relationship defining a small gap (approximately $\frac{1}{4}$ to $\frac{1}{2}$ inch) between their ends. Plating solution passes through flow chamber 10 and the gap defined by fiber optic elements. Light from lamp 11 is passed through one element, through the plating solution within the gap defined by the fiber optic elements, into the opposing fiber optic element and then to photovoltaic cell 12 which gives a inverse voltage reading. This voltage reading is calibrated to copper concentration and variations in the intensity of the light passing through the plating solution results in variations in voltage which can be used to determine copper concentration and replenishment requirements.

Variation in the voltage from the photovoltaic cell 12 from a pre-set point will generate a signal that will activate a flow of replenisher solution to the plating tank. The replenisher generally comprises an aqueous solution of plating metal ions whereby the plating solution will be replenished with plating metal. For example, the signal will activate a metering pump (not shown) that will meter solution from a storage container (not shown) into the plating solution. It is customary to combine other plating solution constituents with the plating metal solution to replenish non-consumable components such as stabilizers and complexing agents that are often lost through drag-out, etc.

Following copper determination, the plating solution continues through line 6. An acidified stream of plating poison is conveniently introduced into the plating solution at this point in the process. The plating poison is contained within holding tank 7. It is passed into the stream of plating solution through line 13 using metering pump 14 and check valve 15. A mixing coil 16 may be contained in line 6 to facilitate the mixing of the plating solution with the plating poison. Since plating poison has been added to the plating solution, the plating solution is essentially incapable of depositing copper onto any of the sensing devices or lines within the controller.

Downstream from mixing coil 16, metering pump 17 controls the flow of the poisoned plating solution through the remaining sensing portions of the controller. The poisoned plating solution is conducted through a first meter or measuring device 18 for pH determination using a conventional pH measuring device. When making a pH determination, provision must be made for the effect of the acid metered into the plating solution with the plating poison. Since the amount of acid metered into solution is pre-set and does not vary, a simple conversion of pH to obtain hydroxide content within the plating tank is required.

Variation of pH from a pre-set point will result in the generation of a signal that activates a pump for replenishment of the solution with an aqueous solution of hydroxide to return the hydroxide content within the plating solution to a desired level. Again, a metering pump in combination with a storage container (not shown) can be used for replenishment of the hydroxide.

The next step in the process comprises determining formaldehyde content. To accomplish this, a small sample of the poisoned plating solution is required and the bulk of the test solution may be discharged through line 19. The remainder of the test solution is passed through line 6 assisted by metering pump 20.

The test solution is next passed through check valve 21 where a stream of sodium sulfite solution is pumped from container 22 through line 23 using metering pump 24. To facilitate the mixing of the sulfite solution with the poisoned plating solution, the combined streams pass through mixing coil 25. For accurate pH determination, it is desirable that the pH be reduced further and acid, from acid tank 26, is passed through line 27 by pump 28 and introduced into the plating solution stream through check valve 29. The acid stream is mixed with the plating solution stream with the aid of mixing coil 30.

The sulfite reacts with the formaldehyde in the plating soluion to produce hydroxide ions, thereby raising the pH of the plating solution stream. The pH of the solution is read on pH meter 31 and following a reading of pH, the solution is discharged through line 32. The pH is corrolated with formaldehyde content and variation of the pH from a pre-set point will generate a signal that activates means to replenish the plating solution with an aqueous solution of formaldehyde or a source of formaldehyde such as paraformaldehyde.

The method of operating the system is described in connection with the following example where a freshly prepared copper plating solution having the following formulation was used for purposes illustration:

| | |
|---|---|
| Copper sulfate | 10 gms/liter |
| Copper complexor | 20 gms/liter |
| Formaldehyde | 9 gms/liter |
| Sodium Hydroxide | 25 gms/liter |
| Sulfur Stabilizer | 2 ppm |
| Water | to 1 liter |
| pH | 12.5 |

Additional treatment solutions necessary for use of the controller comprise an aqueous sulfuric acid solution of thiourea as a plating solution poison in a concentration of 0.25 grams/liter and an aqueous 3.0 molar solution of sodium sulfite as the source of sulfite.

The example illustrates the use of the apparatus diagramatically depicted in the drawing and described above. The process begins with the freshly prepared electroless copper plating solution prior to the introduction of any work pieces into the bath, but after the system has been allowed to reach equilibrium—generally within a few minutes of make-up. With a fresh solution, datum points or calibration of the system can be determined for automatic control of the plating solution during use.

To initiate the process, solution is continuously withdrawn from the plating tank at a rate of 400 ml per minute with 396 ml per minute returned to the plating tank and 4 ml per minute passed into the controller. This insures a uniform sample at all times in the controller and permits the controller to be at a remote point from the plating tank with only a minimal lag time.

The plating solution stream entering the controller passes through the copper sensor portion of the controller apparatus without alteration of the solution. Copper concentration is determined using the fiber optic elements described above. The intensity of light passing through the plating solution is measured and the value obtained is selected as the datum level for copper concentration. A voltage of 100 mv is selected for this datum level. A variation of 2 mv from this initial reading causes a signal to be generated which activates a pump that meters copper replenisher solution to the copper plating tank. In addition to copper sulphate as a copper salt, the copper replenishment solution may contain other non-consumable ingredients lost by drag-out to the plating solution such as stabilizers, complexers, etc.

Following the determination of copper content, the steam of copper plating solution, still at a flow rate of 3.5 ml/minute, is mixed with the acidified thiourea solution introduced at a flow rate of 3.5 ml/minute for a total flow through the system of 7 ml/minute. The concentration of divalent sulfur ion in the plating solution at this point is about 10 parts per million parts of solution, an amount more than adequate to prevent plate-out of metal under conditions encountered within the controller.

Following admixture with the plating solution poison, the solution is passed to a pH measuring device where the pH of the solution is determined. As with copper concentration, the pH value of a fresh plating solution is used as a datum point and deviations from this datum point generates a signal that activates a metering pump that meters hydroxide solution to the plating tank to adjust pH. The replenisher solution comprises an aqueous solution of sodium hydroxide and a deviation of 0.1 in pH results in activation of the metering pump.

Next, following pH analysis for hydroxide determination, the solution is ready for a determination of formaldehyde content. The bulk of the plating solution is discharged and 2.5 ml/minute of the poisoned plating solution is mixed with 3.5 ml/minute of the sulfite solution and 3.5 ml/minute of the acid solution. The initial pH reading for the formaldehyde determination is used as the datum level and variations of 0.1 in pH results in the generation of a signal that activates a pump which meters a formaldehyde or paraformaldehyde solution into the plating tank.

It should be recognized that plating solution is continuously passed through the control apparatus. Consequently, as each replenisher is added, the change in concentration is monitored in the controller. Therefore, the concentration of a replenished component will return to its initial concentration and the analysis of each component will return to its original datum level. Once the original datum level is achieved for any component, the signal generated will terminate and the flow of the replenisher component into the plating solution will stop.

The description has been primarily directed to the replenishment of a copper plating solution. However, the controller may be used to monitor and control the concentration of the components of almost any electroless plating solution. For example, if a plating solution is an electroless nickel plating solution that uses hypophosphite as the reducing agent, the photovoltaic cell is as effective a means for monitoring nickel content as copper content. The pH control is readily measured using the pH meter. Finally, hypophosphite concentration can be determined using known methods of continuous titration and ingestion.

We claim:

1. Apparatus for maintaining the consumable components of an electroless plating solution at predetermined concentration in a plating tank containing said plating solution while workpieces are being processed in the tank, said consumable components comprising plating metal ions, pH adjustor and reducing agent, said apparatus comprising in combination:

means for withdrawing a sample stream of plating solution at a predetermined rate from the plating tank and passing the same through a sequence of analyzing stations to a point of discharge;

a first station consisting of means for analyzing the metal ion content of the sample stream and means operatively connected to and actuated by said metal ion analyzng means to meter plating metal ions to said electroless plating solution so as to replenish said solution with said ions;

means for introducing into said sample stream a source of plating solution poison in an amount capable of preventing metal from plating from said solution, said means being located after said first station;

a second station located after said means for introducing poison into said sample stream consisting of a pH analyzing station having means for measuring the pH of the sample stream, and means operatively connected to and actuated by said pH measuring means to meter pH adjustor to said electroless plating solution so as to replenish said solution with said adjustor; and a third station consisting of a reducing agent analyzing station having means for measuring the concentration of reducing agent, and means operatively connected to and actuated by said means for measuring reducing agent concentration to meter reducing agent to said electroless plating solution so as to replenish said solution with said reducing agent.

2. Apparatus as defined in claim 1 where the plating solution is an electroless copper plating solution.

3. Apparatus as defined in claim 2, further including a source of aqueous sulfite solution and a source of aqueous acid solution, each of standardized molar concentration, and means for mixing said solutions into said sample stream at a constant predetermined rate, downstream of said second station and upstream of said third station.

4. The apparatus of claim 3 where said means for measuring the concentration of reducing agent comprises a second pH analyzing station having means for measuring the pH of the sample stream downstream of the point of introduction of the sulfite solution and the acid solution.

* * * * *